US005970904A

United States Patent [19]

Wellen et al.

[11] Patent Number: 5,970,904

[45] Date of Patent: Oct. 26, 1999

[54] BOAT COVER FASTENING SYSTEM

[75] Inventors: Gerald E. Wellen, North Branch; Timothy J. Menne, Pine City; Robert J. Menne, Jr., Forest Lake, all of Minn.

[73] Assignee: Premier Marine, Inc., Wyoming, Minn.

[21] Appl. No.: 08/982,859

[22] Filed: Dec. 2, 1997

Related U.S. Application Data

[63] Continuation-in-part of application No. 08/651,904, May 21, 1996, Pat. No. 5,706,753.

[51] Int. Cl.[6] ..... B63B 17/00

[52] U.S. Cl. ..... 114/361; 296/163

[58] Field of Search ..... 114/361; 135/87.1; 296/163, 164, 100; 24/907

[56] References Cited

U.S. PATENT DOCUMENTS

| | | | |
|---|---|---|---|
| 2,198,396 | 6/1940 | Davis | 296/100 |
| 3,122,394 | 2/1964 | Bryden . | |
| 3,172,419 | 3/1965 | Lewis | 114/361 |
| 3,186,129 | 6/1965 | Blood . | |
| 3,426,400 | 2/1969 | Lauro | 24/907 |
| 3,572,353 | 3/1971 | Pinkley | 114/361 |
| 4,639,033 | 1/1987 | Wheatley et al. | 296/100 |
| 5,058,652 | 10/1991 | Wheatley et al. | 296/100 |
| 5,152,574 | 10/1992 | Tucker | 296/100 |
| 5,215,032 | 6/1993 | Ellis et al. | 114/361 |

*Primary Examiner*—Jesus D. Sotelo
*Attorney, Agent, or Firm*—Hugh D. Jaeger

[57] ABSTRACT

Boat cover fastening system for aquatic craft utilizing a rail having a continuous securement channel along its length which receives a plurality of cover mounted flexible spring clips distributed along the periphery of the boat cover. An alternate embodiment discloses a flexible spring clip having members of different flexibilities.

5 Claims, 8 Drawing Sheets

BOAT COVER FASTENING SYSTEM

CROSS REFERENCES TO CO-PENDING APPLICATIONS

This patent application is a continuation-in-part of application Ser. No. 08/651,904 now U.S. Pat. No. 5,706,753, filed May 21, 1996.

BACKGROUND OF THE INVENTION

1. Field of the Invention

The present invention is for a cover system for an aquatic craft, and more particularly, pertains to a cover system which is readily installed on or removed from an aquatic craft.

2. Description of the Prior Art

Prior art boat cover devices have often included a snap system having a male snap member secured to a surface of the aquatic craft which mates with a corresponding female snap member secured to the canvas or plastic cover member. Initial alignment and installation of the female snap member on the cover member proved to be a demanding and time consuming task and often the mating parts were found to be out of desirable alignment when weather elements caused stretching or shrinking of the cover member. Stress points were created on the boat cover material in the area of the female snap members causing undue stress and possible separation of material at the snap. Clearly what is needed is a boat cover fastening system which is easily fabricated, which distributes stress, and which is quickly and easily installed on or removed from an aquatic craft.

The present invention overcomes the shortcomings of various prior art devices by providing a suitable boat cover fastening system.

SUMMARY OF THE INVENTION

The general purpose of the present invention is a boat cover fastening system.

According to one embodiment of the present invention, there is provided a boat cover fastening system for quick and ready securing of or removal from an aquatic craft or other vehicle, craft or device. The system includes a uniquely coupled rail and flexible spring clip system whereby a number of flexible spring clips are distributively attached along the outer periphery of a fabric boat cover and subsequently received by a continuous securement channel resident in the rail which is mounted about the edge of an aquatic or other craft such as a pontoon boat, motor boat or sailboat. The flexible spring clips are mounted in the approximate desired location along the cover periphery location but do not require exacting fabricational placement as do various prior art devices. The flexible spring clips are fashioned in one piece of plastic having a spring-like quality. Opposing members of the flexible spring clip are forced apart during insertion of an angled flexible spring clip tip into the continuous securement channel in the rail and then released to provide a captured junction between the rail and the flexible spring clip. An alternate embodiment discloses a one-piece flexible spring clip comprised of suitable durometer and Rockwell hardness reading plastic having a rigid "J" clip of suitable Rockwell hardness reading and a flexible panel of suitable durometer reading, which is substantially more flexible than the rigid "J" clip. The flexible panel is of sufficient durometer to accommodate attachment, such as by stitching, to the boat cover and also offers sufficient pliability to conform to the flexible geometry of the boat cover fabric and boat rail geometry to allow the boat cover to be easily installed. Any number of flexible spring clips of various lengths can be used to effect a proper securement of the boat cover to the rail.

One significant aspect and feature of the present invention is a boat cover fastening system which readily attaches to or is readily removed from an aquatic craft.

Another significant aspect and feature of the present invention is a boat cover fastening system which includes a rail having a securement channel for accommodation of a flexible spring clip.

Another significant aspect and feature of the present invention is a boat cover fastening system having a flexible spring clip which engages a securement channel.

Another significant aspect and feature of the present invention is a boat cover fastening system having one or more flexible spring clips to which the boat cover is attached.

Another significant aspect and feature of the present invention is a boat cover fastening system having a plurality of flexible spring clips attached to the periphery of the boat cover.

Another significant aspect and feature of the present invention is a boat cover fastening system which is readily fabricated and which does not require exacting placement along the periphery of the boat cover during initial fabrication or custom fitting.

Another significant aspect and feature of the present invention is a boat cover fastening system which, due to the width of the flexible spring clips, distributes stress or tension in the areas of attachment to the boat cover material.

Another significant aspect and feature of the present invention is a boat cover fastening system which includes a planar member and a panel-receiving channel for accommodation of a panel.

Another significant aspect and feature of the present invention is a flexible spring clip of durometer and/or Rockwell hardness reading plastic which has suitable and appropriate degrees of appropriately located flexibility to allow easy installation to a boat rail.

Another significant aspect and feature of the present invention is the utilization of a rigid "J" clip of a suitable Rockwell hardness reading and a flexible panel of suitable durometer reading in combination to form a flexible spring clip.

Another significant aspect and feature of the present invention is a rigid "J" clip of suitable Rockwell hardness which flexes appropriately during rail engagement, and whose shape is not significantly affected by extremely high or low temperatures to the extent that the "J" clip will adversely soften and deform in a high temperature environment or become brittle and crack in a low temperature environment.

Another significant aspect and feature of the present invention is a flexible panel of suitable durometer reading which accommodates stitching without causing the flexible panel to fatigue or fail along the stitch line.

Another significant aspect and feature of the present invention is a flexible panel of suitable durometer reading which accommodates stitching during the boat cover fabric to flexible spring clip fabrication, thereby allowing stitching to be incorporated as an economical construction and fabrication method.

Another significant aspect and feature of the present invention is the mating by stitching or other suitable means of the boat cover fabric to the flexible panel of the flexible spring clip whereby the boat cover fabric/flexible panel combination offers a flexible and maneuverable gripping area which is easily and readily manually positioned in order to engage the rigid "J" clip into a securement channel in a rail.

Still another significant aspect and feature of the present invention is a thickened reinforced flexible panel area aligned over and about an upper edge of a rigid "J" clip.

Having thus described significant aspects and features of embodiments of the present invention, it is the principal objective hereof to provide a boat cover fastening system.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
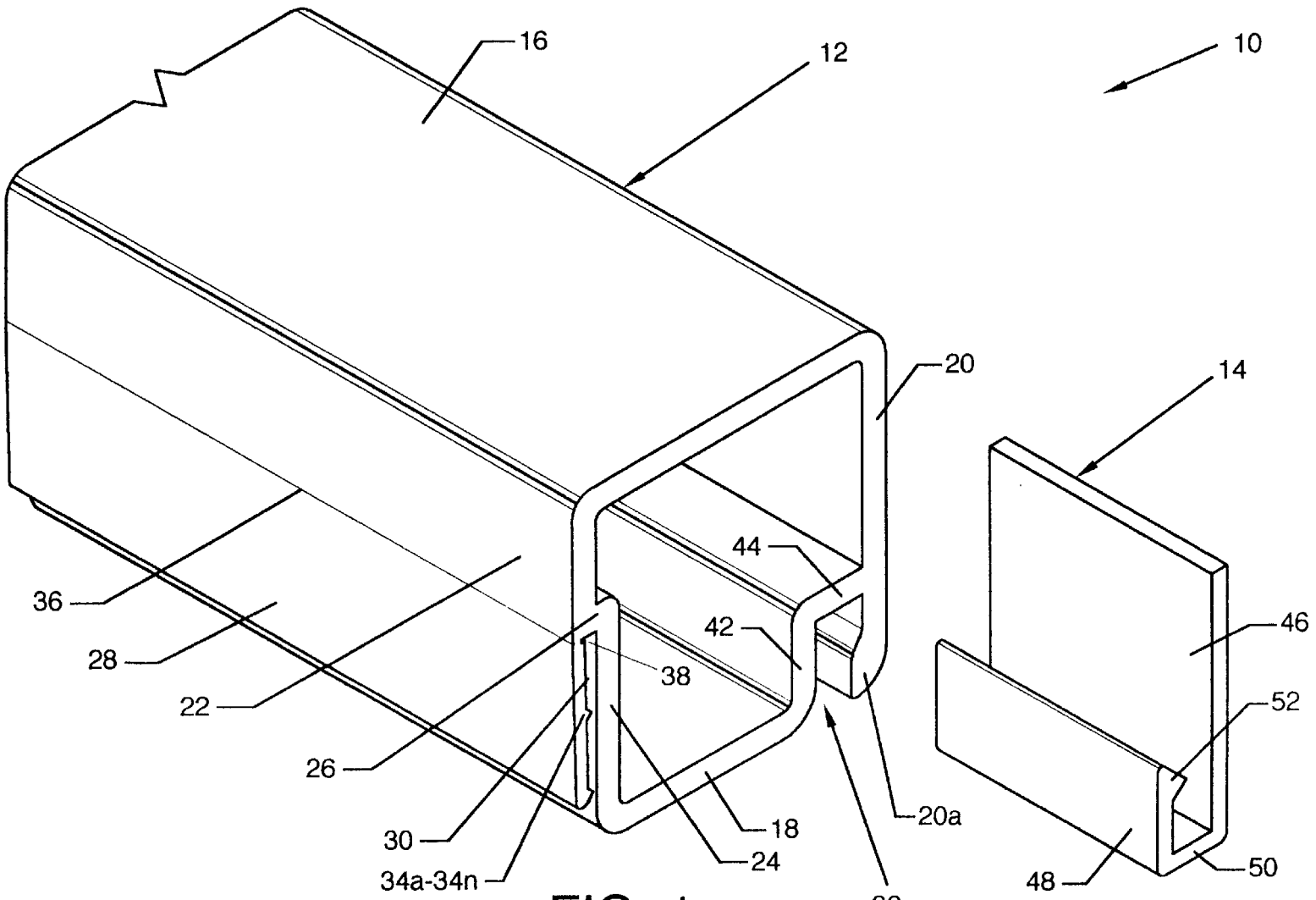
FIG. 1 illustrates an isometric view of a boat cover fastening system.

FIG. 1 illustrates an isometric view of a boat cover fastening system 10, the present invention, including a rail 12 and a flexible spring clip 14 which engages the rail 12. The rail 12 is constructed of aluminum or other suitable material in the general shape of a box tube, and includes a horizontally disposed planar top wall 16; a horizontally disposed planar bottom wall 18; an inboard sidewall extending between the planar top wall 16 and the planar bottom wall 18 and comprising a vertically disposed upper inboard planar wall member 22 joining the planar top wall 16 along a first top edge, a vertically disposed lower inboard planar wall member 24 offset inwardly from the upper inboard planar wall member 22 and joining the planar bottom wall 18 along a first bottom edge, and a horizontally disposed inboard horizontal planar wall member 26 connecting the upper inboard planar wall member 22 to the lower inboard planar wall member 24 at a location spaced upwardly from the planar bottom wall 18; an outboard sidewall extending between the planar top wall 16 and the planar bottom wall 18 and comprising a vertically disposed upper outboard planar wall member 20 joining the planar top wall 16 along a second top edge, a vertically disposed lower outboard planar wall member 42 offset inwardly from the upper outboard planar wall member 20 and joining the planar bottom wall 18 along a second bottom edge, and a horizontally disposed outboard horizontal planar wall member 44 connecting the upper outboard planar wall member 20 to the lower outboard planar wall member 42 at a location spaced upwardly from the planar bottom wall 18; a vertically aligned planar member 28 extending downwardly from the junction of the upper inboard planar wall member 22 and the inboard horizontal planar wall member 26 and having an exterior surface lying in the same plane as the outer surface of the upper inboard planar wall member 22 and an interior surface spaced from the lower inboard planar wall member 24; a panel-receiving channel 30 defined by the planar member 28, the lower inboard planar wall member 24, and the inboard horizontal planar wall member 26 for accommodation of a panel; and a configured securement channel 32 formed by an extension 20*a* of the upper outboard planar wall member 20, the lower outboard planar wall member 42, and the outboard horizontal planar wall member 44. The extension 20*a* of the upper outboard planar wall member 20 terminates in an enlarged tip with a rounded surface 66 which curves inwardly toward the lower outboard planar wall member 42 at the entrance to the securement channel 32. The extension 20*a* also includes a ramped surface 68 located within the securement channel 32 and which tapers upwardly and outwardly.

Planar member 28 includes one or more ridge lines 34*a*–34*n* extending inwardly into the panel-receiving channel 30 for securing a panel. A score line 36 marking the division of the upper inboard planar wall member 22 and the planar member 28 and an undercut 38 at the junction of the inboard horizontal planar wall member 26 and the planar member 28 provide a living hinge to facilitate movement of the planar member 28 to accommodate a panel illustrated in FIG. 5. Securement channel 32 accommodates and snappingly engages flexible spring clip 14.

Flexible spring clip 14 is formed in one piece of flexible plastic, or other such suitable material and assumes a "J" shape. The one-piece flexible spring clip 14 includes opposing vertically oriented spaced apart planar first and second legs 46 and 48 joined by an interceding horizontally aligned planar bight portion 50. The legs 46 and 48 extend substantially perpendicularly from the planar bight portion 50 and terminate in free ends. The legs 46 and 48 together with the planar bight portion 50 define a channel opening in the direction of the free ends of the legs. As illustrated, leg 46 is longer than leg 48, thereby giving the flexible spring clip a "J" shape. An engaging portion in the form of an angle portion 52 is included at the free end of planar leg 48 to facilitate entry of the planar leg 48 into the securement channel 32, as later described in detail.

Figure 2:
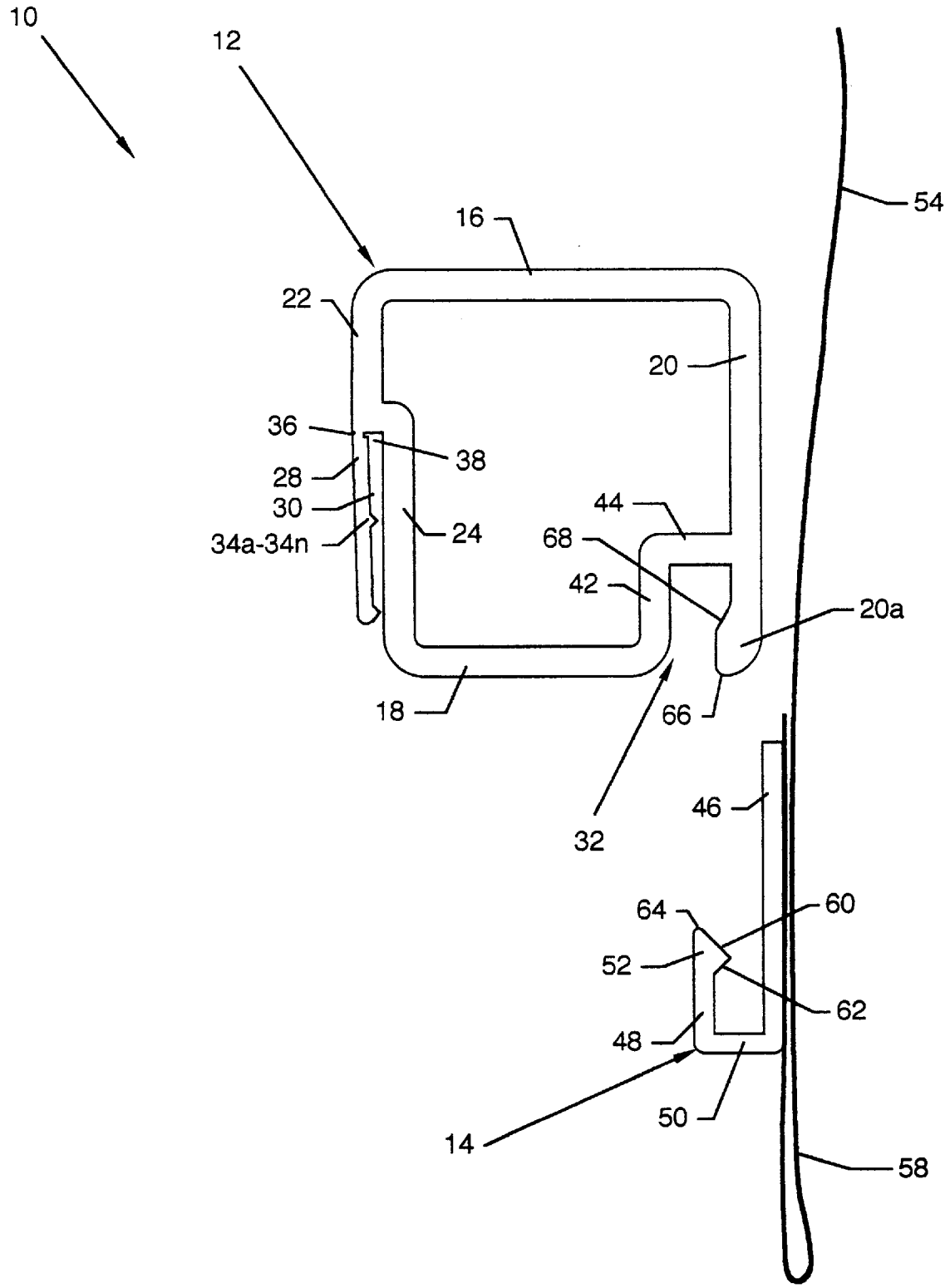
FIG. 2 illustrates an end view of a rail and a flexible spring clip prior to mutual engagement.

FIG. 2 illustrates an end view of the rail 12 and the flexible spring clip 14 prior to mutual engagement where all numerals correspond to those elements previously described. One end of a boat cover 54 of canvas, plastic or other suitable material is secured along the length of the flexible spring clip 14 in double-back fashion to the leg 46 of the flexible spring clip 14 such as by stitching, glue bonding, electronic welding or other such suitable fastening means. Material extends below the flexible spring clip 14 to serve as a looped gripping member 58 to aid in insertion or removal of the flexible spring clip 14 into or from the securement channel 32 of the rail 12. The angle portion 52 of the flexible spring clip 14 includes upper and lower angled surfaces 60 and 62 which assist in inward or outward flexing of the planar legs 46 and 48 with respect to each other across planar bight portion 50 for insertion or removal of the flexible spring clip 14 into or out of the securement channel 32 of the rail 12. A rounded surface 64 is also included at the junction of upper angled surface 60 and the outer surface of planar leg 48 to assist insertion of the angle portion 52 into securement channel 32 if required. A rounded surface 66 is included at the end of the curved enlarged tip of extension 20*a* to assist in insertion of the angle portion 52 into the securement channel 32 if required. A ramped surface 68 tapering upwardly and inwardly aligns on the inner surface of the curved enlarged tip of extension 20*a* to assist in removal of the flexible spring clip 14 from the securement channel 32 of the rail 12.

Figure 3:
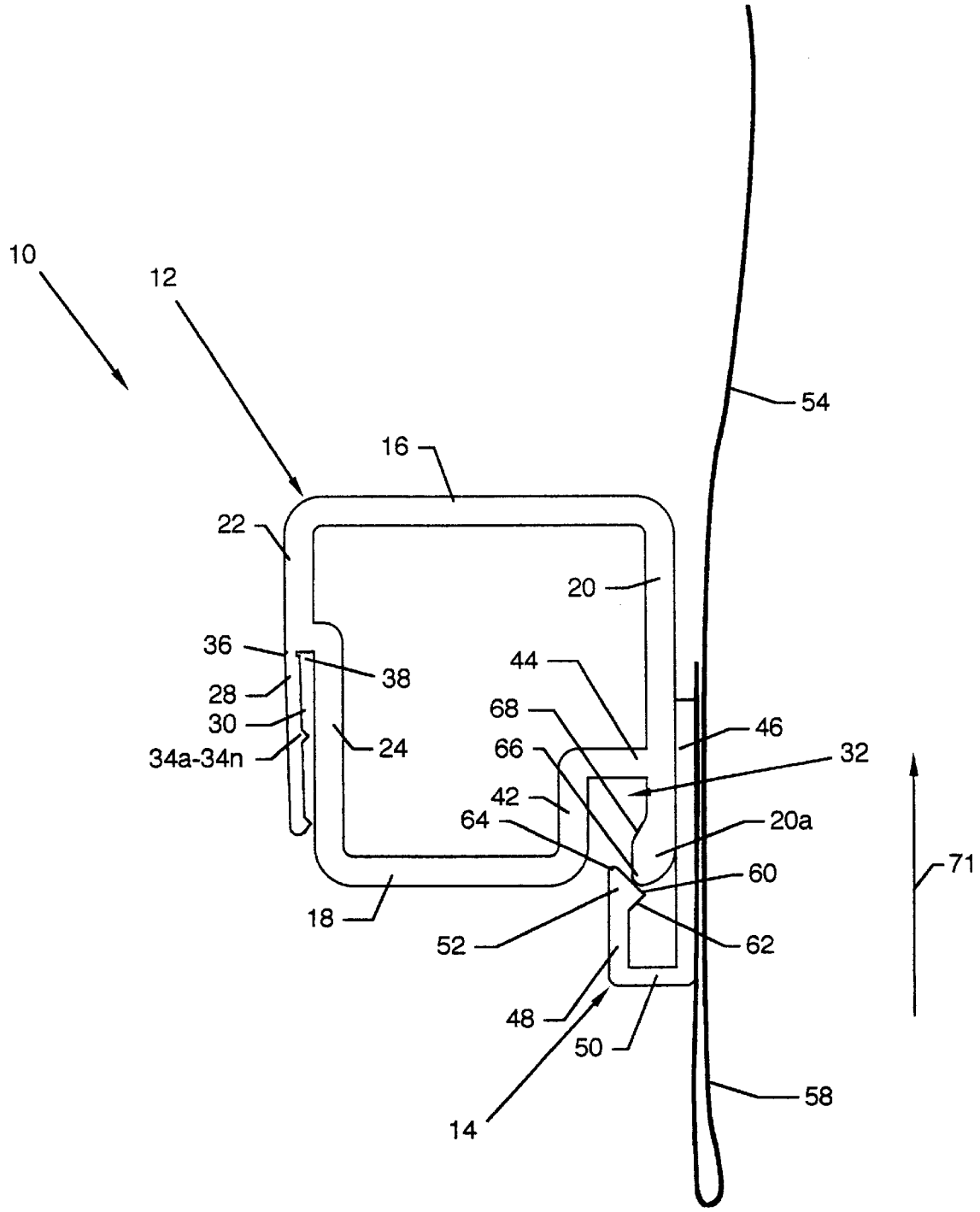
FIG. 3 illustrates an end view of the rail and the flexible spring clip during insertion prior to mutual engagement.

FIG. 3 illustrates an end view of the rail 12 and the flexible spring clip 14 during insertion prior to mutual engagement where all numerals correspond to those elements previously described. Upper angled surface 60 of the angle portion 52 contacts the rounded surface 66 of the curved enlarged tip of extension 20*a* as the flexible spring clip 14 is manually positioned upwardly, as shown by arrow 71, with respect to the rail 12, during the insertion process. During this upward movement the opposing planar legs 46 and 48 of the flexible spring clip 14 are forced apart about the common bight portion 50 to allow further vertical positioning of the members of flexible spring clip 14 about and within the members of the securement channel 32. Upper and lower angled surfaces 60 and 62 meet at an acute angle, thereby forming a sawtooth configuration. Surfaces 66 and 68 form a locking or engaging hump behind which the angle portion 52 engages. Other like or similar engaging geometries can be utilized within the teachings of this present invention.

Figure 4:
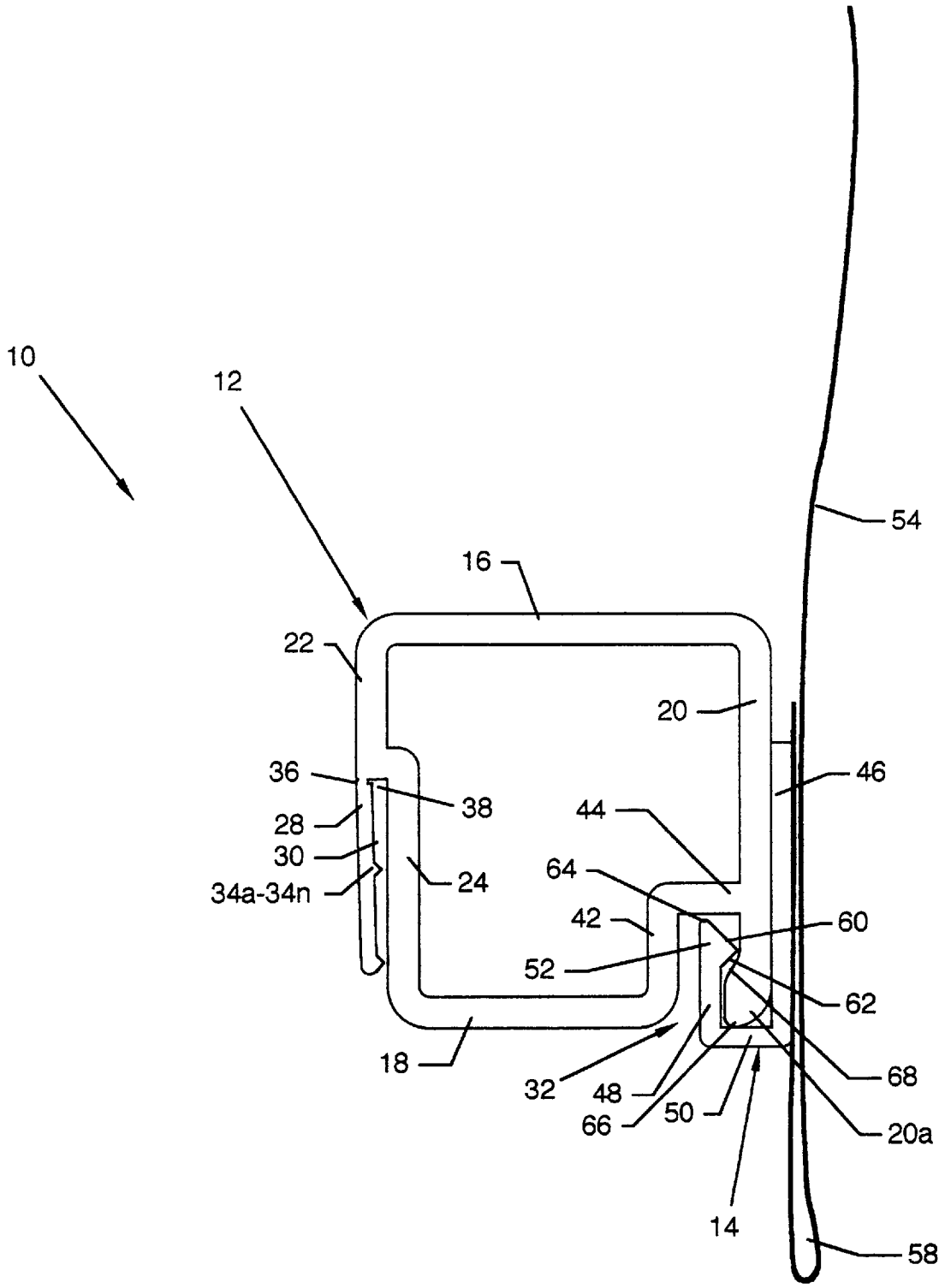
FIG. 4 illustrates an end view of the rail and the flexible spring clip in full mutual engagement.

FIG. 4 illustrates an end view of the rail 12 and the flexible spring clip 14 in full mutual engagement where all numerals correspond to those elements previously described. The angle portion 52 and a major portion of the planar leg 48 are shown inserted into and captured by the securement channel 32; moreover, the curved enlarged tip of extension 20*a* is encompassed in secure engagement by the members of the flexible spring clip 14. Planar leg 46, including the secured boat cover 54, is held to the upper outboard planar wall member 20.

MODE OF OPERATION

Figure 5:
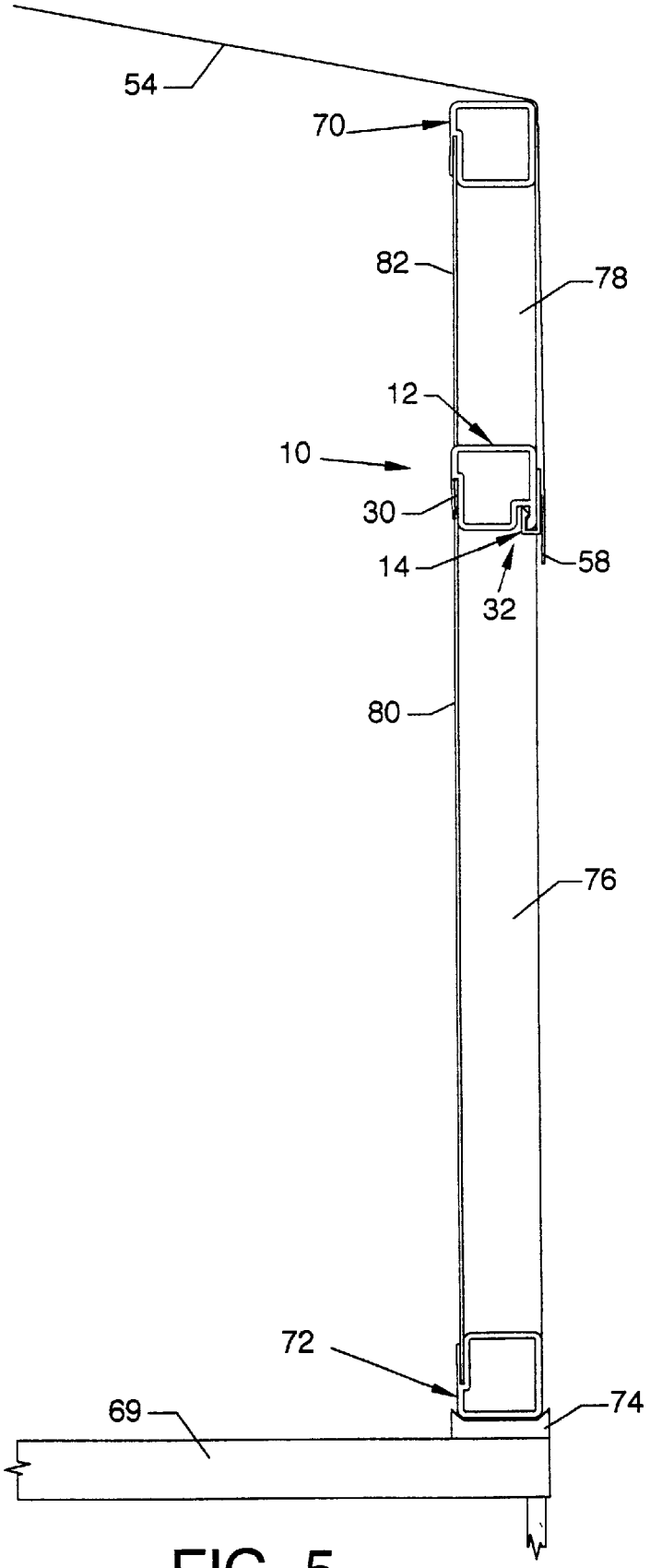
FIG. 5 illustrates the use of the boat cover fastening system secured to a rail structure on a deck of a pontoon boat or other watercraft.

FIG. 5 illustrates the use of the boat cover fastening system 10 with various other rail members secured to the deck 69 of a pontoon boat or other watercraft where all numerals correspond to those elements previously described. The rail 12 is illustrated in conjunction with upper and lower rails 70 and 72. Rails 70 and 72 each have a profile shape similar to that of the rail 12; however, a channel, such as securement channel 32 is not necessarily included in the upper and lower rails 70 and 72. However, a rail, such as rail 12 or variations of rail 12, could be incorporated at an upper or lower position to accommodate full or partial covering along the side rails of a watercraft or other craft as desired. A mounting channel 74 serves as an intermediate mounting structure between the deck 69 and the lower rail 72. The horizontally mounted rails 12, 70 and 72 mount to a plurality of vertically oriented members 76 and 78 having similar shapes and features found on the upper and lower rails 70 and 72. Panel 80 secures in panel-receiving channel 30 of the rail 12 and a corresponding inverted space in the lower rail 72. A panel 82 secures in a space in the upper rail 70 and extends to the rail 12. The flexible spring clip 14 is illustrated in engagement with securement channel 32 of the rail 12. A plurality of flexible spring clips 14 are located at appropriate distances along the looped gripping member 58 so that the boat cover 54 may be held and fastened at appropriate intervals as required along the rail(s) to maintain proper tensioning of the boat cover 54.

ALTERNATIVE EMBODIMENT

Figure 6:
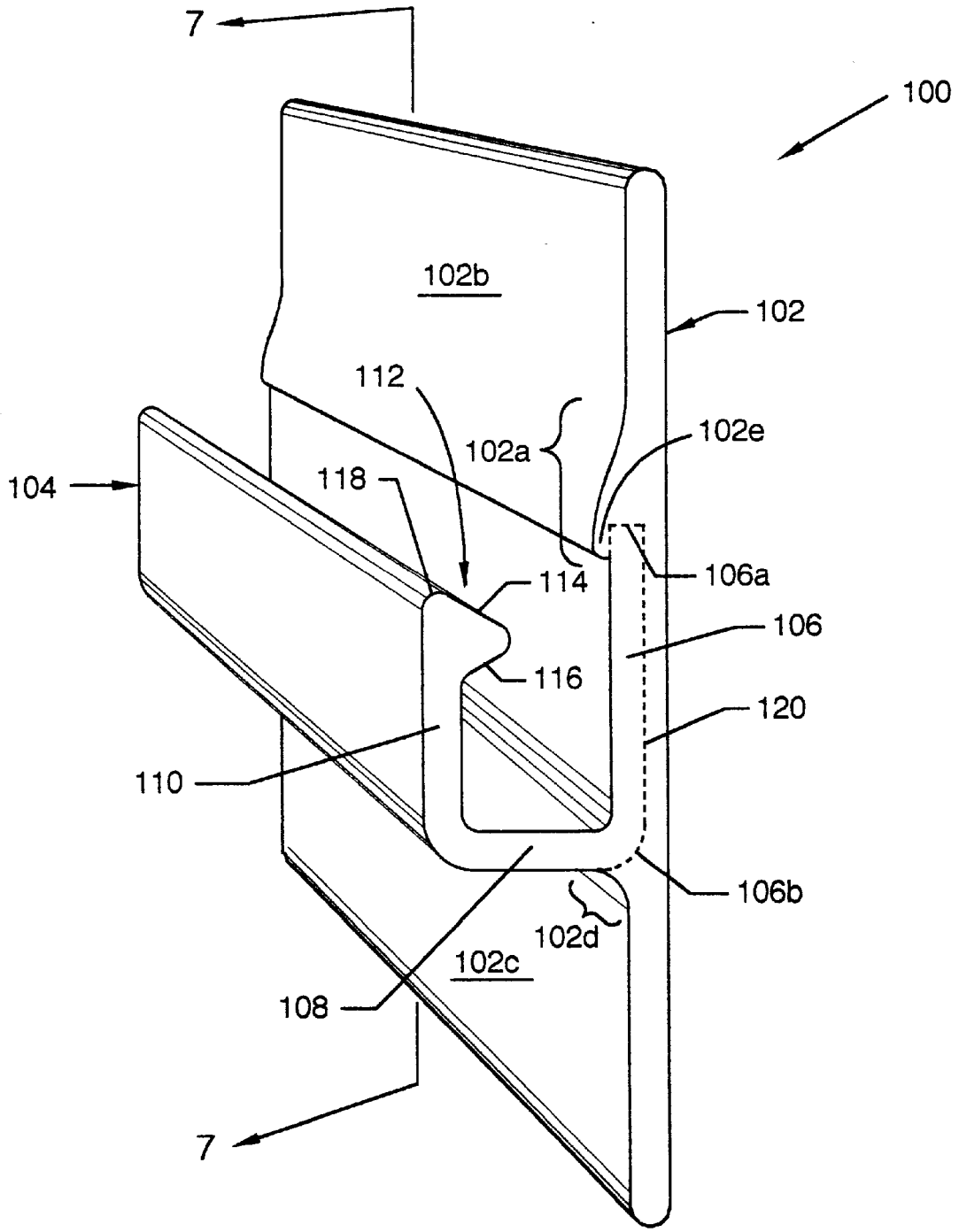
FIG. 6, an alternate embodiment, illustrates a perspective view of a flexible spring clip.

FIG. 6, an alternative embodiment, illustrates a perspective view of a flexible spring clip 100 which can be utilized in a fashion much similar to the flexible spring clip 14, previously described. The flexible spring clip 100 frictionally engages a rail, such as rail 12 previously described, to secure an attached boat cover to a rail, such as rail 12. The flexible spring clip 100 is of co-extruded polymer construction. A flexible panel 102 of polymer having an 80 durometer Shore A in a range of 75–85 durometer Shore A reading, by way of example and for purpose of illustration only, and a rigid "J" clip 104 of PVC polymer having a Shore D hardness reading in a range from 70 to 85, are combined and formed as a single homogenous unit during co-extrusion to comprise the flexible spring clip 100. The flexible panel 102 attaches to a boat cover, preferably by stitching, or can also be attached such as by electronic welding, adhesive or other suitable means, and is of suitable durometer reading to offer reasonable flexibility to compatibly flex, bend and otherwise operate in concert with the boat cover material. The rigid "J" clip 104, being substantially less flexible than the flexible panel 102 and of suitable Rockwell hardness reading, extends outwardly from the flexible panel 102. The rigid "J" clip 104 includes a vertically oriented first planar leg 106, a horizontally aligned planar bight portion 108 extending perpendicularly from the vertically oriented first planar leg 106, a vertically oriented second planar leg 110 extending perpendicularly from the horizontally aligned planar bight portion 108, and an angle portion 112 at the upper end of the vertically oriented second planar leg 110 corresponding to the angle portion 52 previously described. The upper end 106*a* of the vertically oriented first planar leg 106 is surrounded by a thickened area 102*a* located at the lower region of the flexible panel portion 102*b* and a like thickened area 102*d* located at a lower end 106*b*. The thickened area 102*a* surrounds and encompasses at 102*e* the upper end 106*a* to reinforce the area around and about the upper end 106*a*, and also prevents flex fatigue of the flexible panel 102 at the area of the flexible panel 102 adjoining the upper end 106*a* of the vertically oriented first planar leg 106. The angle portion 112 of the rigid "J" clip 104 includes upper and lower angled surfaces 114 and 116 which assist in inward or outward flexing of the planar second and first legs 110 and 106 with respect to each other across planar bight portion 108 for insertion or removal of the flexible spring clip 100 into or out of the securement channel 32 of the rail 12 in a manner similar to that shown in FIGS. 2, 3 and 4. A rounded surface 118 is also included at the junction of upper angled surface 114 and the outer surface of the vertically oriented second planar leg 110 to assist insertion of the angle portion 112 into securement channel 32, if required. The vertically oriented first planar leg 106 of the rigid "J" clip 104 is mated during co-extrusion, or other suitable formational processes of the flexible spring clip 100, to the flexible panel 102 to form a one-piece flexible spring clip 100 having suitable durometer and/or Rockwell hardness readings. Portions 102*b* and 102*c* of the flexible panel 102 are located above and below the area of the flexible panel 102 which forms a junction 120 (shown in dashed lines) with the vertically oriented first planar leg 106 of the rigid "J" clip 104. The durometer readings of the flexible panel portions 102*b* and 102*c* are of suitable values, and allow for sufficient flexibility and hardness to allow stitching through the flexible panel portions 102*b* and 102*c* to a boat cover to be readily and easily accomplished.

Figure 7:
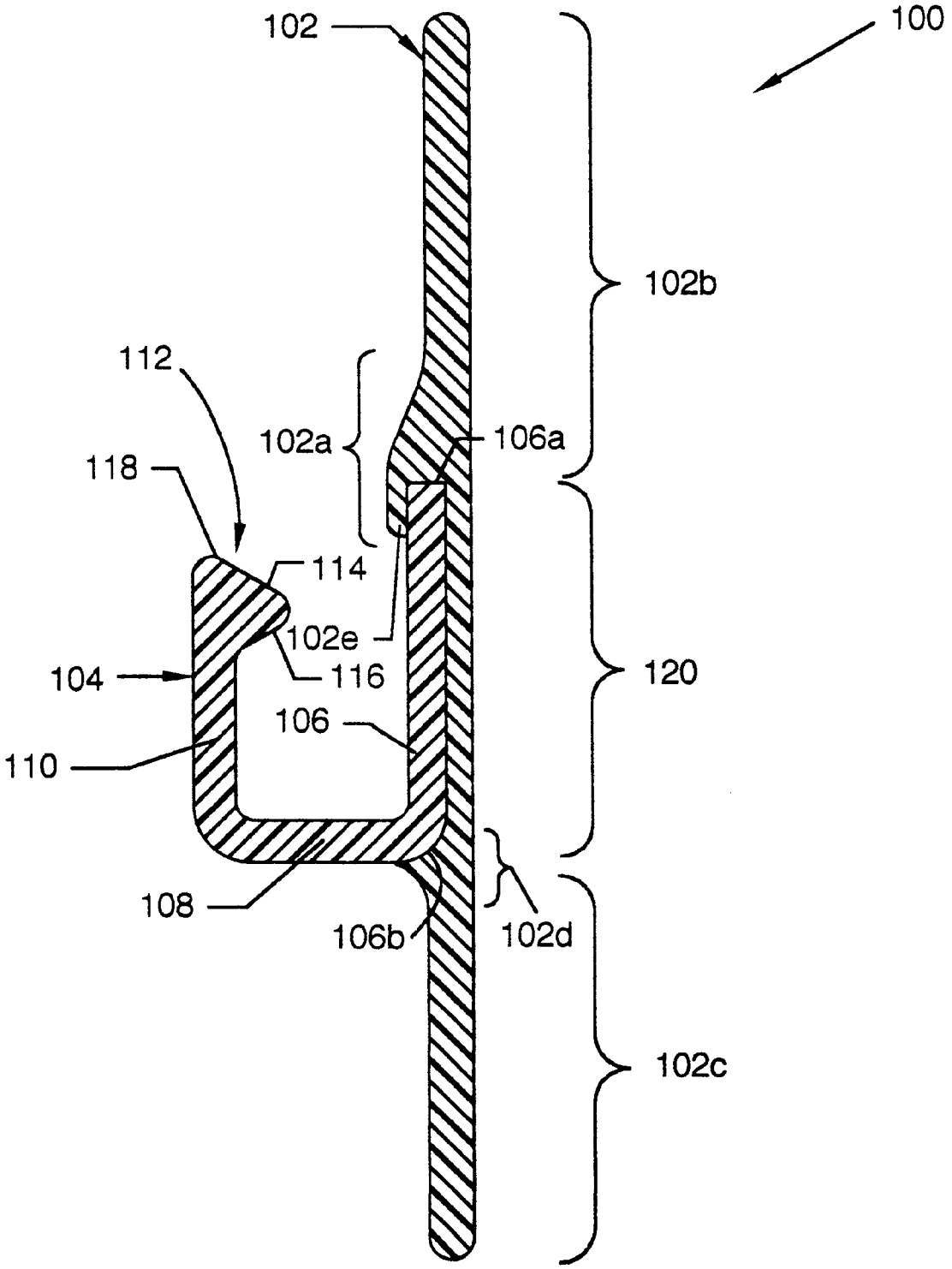
FIG. 7 illustrates a cross sectional view along line 7—7 of FIG. 6 illustrating the members of the flexible spring clip; and, FIG. 8 illustrates the flexible spring clip of FIGS. 6 and 7 secured to a boat cover.

FIG. 7 illustrates a cross sectional view along line 7—7 of FIG. 6, where all numerals correspond to those elements previously described. Illustrated in particular is the junction 120 of the rigid "J" clip 104 with the flexible panel 102, each having separate and distinct Rockwell hardness or durometer readings, respectively, to form the one-piece homogenous flexible spring clip 100.

MODE OF OPERATION OF ALTERNATIVE EMBODIMENT

Figure 8:
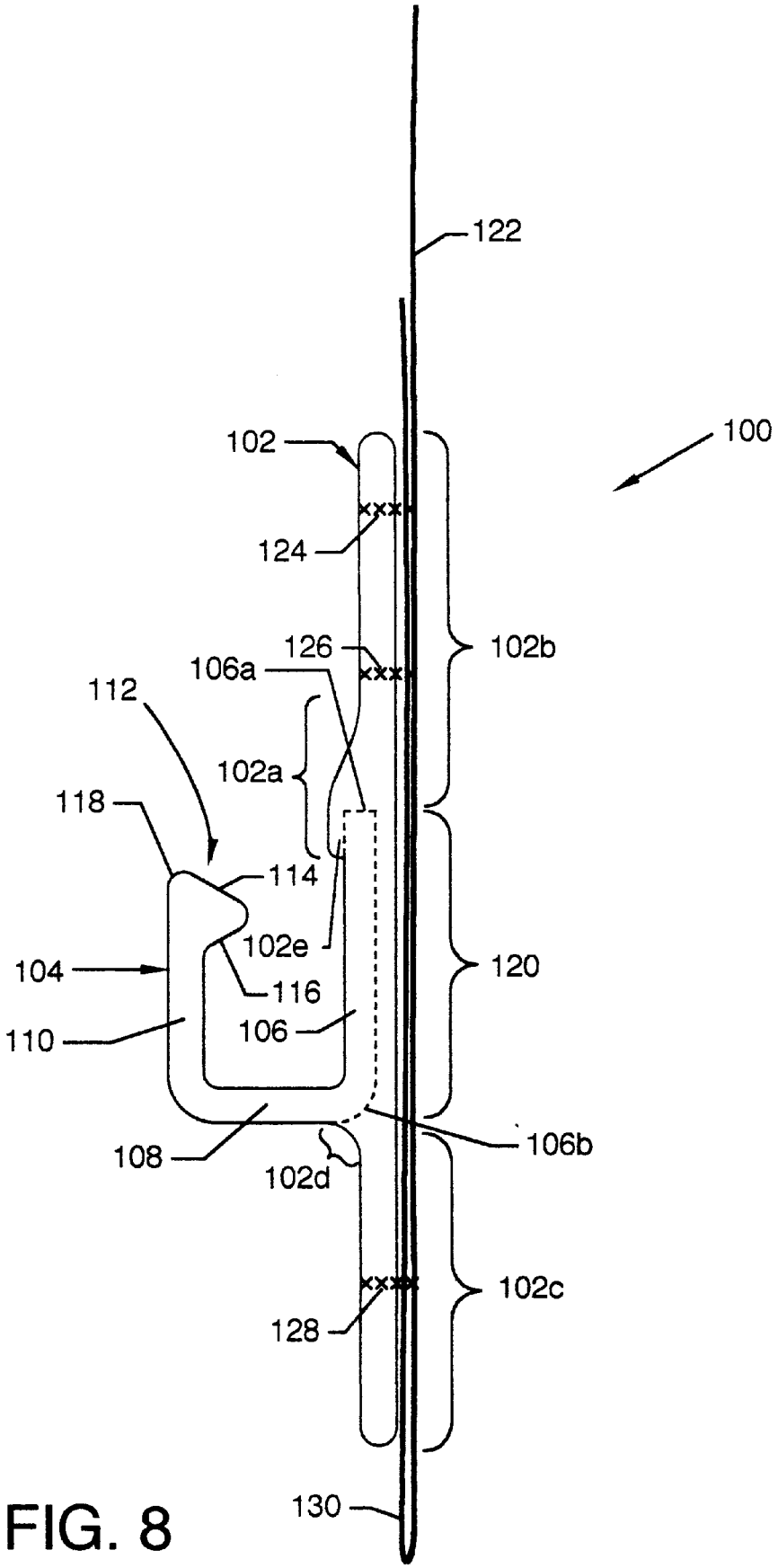

FIG. 8 illustrates the flexible spring clip 100 secured to boat cover 122, such as by stitching. Horizontally aligned stitching rows 124 and 126 pass through and along the length of the flexible panel portion 102*b* and a folded-over portion of the boat cover 122 to secure one or more spring clips 100 to the boat cover 122. Horizontal stitching row 128 passes through and along the length of the flexible panel portion 102*c* and the folded-over portion of the boat cover 122 to assist in fastening of the spring clips 100 to the boat cover 122. A looped gripping member 130 of appropriate dimension is formed by the boat cover to assist in installation of the boat cover, as previously described. Various stitching patterns can be utilized to fasten the flexible spring clips 100 to the boat cover 122 and shall not be deemed to be limiting to the scope and intent of the invention. The clip 100 engages in a like member as illustrated in FIG. 4.

Various modifications can be made to the present invention without departing from the apparent scope hereof.

We claim:

1. A flexible spring clip comprising:

a. a one-piece member formed of flexible material and having a bight portion with opposite ends, a first leg connected at one end to one end of said bight portion and extending substantially perpendicularly from said bight portion and terminating in a free end, and a second leg connected at one end to the other end of said bight portion and extending substantially perpendicularly from said bight portion in the same direction as said first leg and terminating in a free end;

b. said first and second legs together with said bight portion forming a channel opening in the direction of said free ends; and, c. said free end of said second leg having a rounded surface at its tip and an angle portion comprising an upper angled surface extending from said rounded surface forwardly and downwardly into said channel, and a lower angled surface extending from said upper angled surface rearwardly and downwardly, said upper and lower angled surfaces meeting at an acute angle, thereby forming a sawtooth configuration.

2. The flexible spring clip as defined in claim 1, wherein said bight portion, said first leg, and said second leg, except for the angle portion thereof, are planar.

3. The flexible spring clip as defined in claim 1, wherein said first leg is longer than said second leg, thereby giving said one-piece member a "J" shape.

4. A flexible spring clip comprising:

a. a member formed of flexible material and having a bight portion with opposite ends, a first leg connected at one end to one end of said bight portion and extending substantially perpendicularly from said bight portion and terminating in a free end, and a second leg connected at one end to the other end of said bight portion and extending substantially perpendicularly from said bight portion in the same direction as said first leg and terminating in a free end;

b. said first and second legs together with said bight portion forming a channel opening in the direction of said free ends;

c. said free end of said second leg having a rounded surface at its tip and an angle portion comprising an upper angled surface extending from said rounded surface forwardly and downwardly into said channel, and a lower angled surface extending from said upper angled surface rearwardly and downwardly, said upper and lower angled surfaces meeting at an acute angle, thereby forming a sawtooth configuration; and, d. a flexible panel portion joined about an upper end, at a junction, and about a lower end to said spring clip.

5. A flexible spring clip comprising:

a. a member formed of flexible material and having a bight portion with opposite ends, a first leg connected at one end to one end of said bight portion and extending substantially perpendicularly from said bight portion and terminating in a free end, and a second leg connected at one end to the other end of said bight portion and extending substantially perpendicularly from said bight portion in the same direction as said first leg and terminating in a free end;

b. said first and second legs together with said bight portion forming a channel opening in the direction of said free ends;

c. said free end of said second leg having a rounded surface at its tip and an angle portion comprising an upper angled surface extending from said rounded surface forwardly and downwardly into said channel, and a lower angled surface extending from said upper angled surface rearwardly and downwardly, said upper and lower angled surfaces meeting at an acute angle, thereby forming a sawtooth configuration; and, d. a flexible panel portion jointed about and encompassing an upper end with a thickened area, at a junction, and about a lower end with a thickened area to said spring clip.

* * * * *